US007817102B2

(12) United States Patent
Taki et al.

(10) Patent No.: US 7,817,102 B2
(45) Date of Patent: Oct. 19, 2010

(54) ANTENNA, AND RADIO-FREQUENCY IDENTIFICATION TAG

(75) Inventors: Kazunari Taki, Nagoya (JP); Yasumitsu Miyazaki, 6-91, Satsukigaoka, Kani-shi, Gifu-ken (JP) 509-0236

(73) Assignees: Brother Kogyo Kabushiki Kaisha, Nagoya-shi, Aichi-ken (JP); Yasumitsu Miyazaki, Kani-shi, Gifu-ken (JP)

( * ) Notice: Subject to any disclaimer, the term of this patent is extended or adjusted under 35 U.S.C. 154(b) by 116 days.

(21) Appl. No.: 12/032,737

(22) Filed: Feb. 18, 2008

(65) Prior Publication Data

US 2008/0204329 A1 Aug. 28, 2008

(30) Foreign Application Priority Data

Feb. 27, 2007 (JP) ..... 2007-048018

(51) Int. Cl.
*H01Q 1/36* (2006.01)

(52) U.S. Cl. ..... 343/895; 343/700 MS

(58) Field of Classification Search ..... 343/700 MS, 343/895, 802, 804, 806, 828; 340/572.1
See application file for complete search history.

(56) References Cited

U.S. PATENT DOCUMENTS 3,231,894 A * 1/1966 Nagai ..... 343/806
4,381,566 A * 4/1983 Kane ..... 455/193.3
6,642,893 B1 * 11/2003 Hebron et al. ..... 343/702
7,109,945 B2 9/2006 Mori
2007/0023525 A1 * 2/2007 Son et al. ..... 235/454

FOREIGN PATENT DOCUMENTS

JP 2004-228797 A 8/2004

* cited by examiner

*Primary Examiner*—Michael C Wimer
*Assistant Examiner*—Kyana R Robinson
(74) *Attorney, Agent, or Firm*—Baker Botts, LLP.

(57) ABSTRACT

An antenna connected to a circuit portion and configured to effect transmission and reception of information by radio communication, the antenna including a driven meander line portion which has a feed section connected to the circuit portion and which is a line conductor formed in a meandering pattern, and a parasitic meander line portion which does not have a feed section connected to the circuit portion and which is a line conductor formed in a meandering pattern, the parasitic meander line portion being positioned relative to the driven meander line portion, so as to influence an input impedance of the driven meander line portion, wherein the driven and parasitic line portions have respective extensions of the line conductors formed at respective opposite longitudinal ends of the antenna. Also disclosed in a transponder in the form of a radio-frequency identification tag including the antenna and capable of radio communication with an interrogator.

10 Claims, 14 Drawing Sheets

| OPERATIONS | COMMAND | CODES |
|---|---|---|
| TAG IDENTIFICATION | PING | 0x08 |
| | SCROLL ID | 0x01 |
| TAG WRITING | ERASE ID | 0x32 |
| | PROGRAM ID | 0x31 |
| | VERIFY | 0x38 |
| | LOCK | 0x31 |

ID1=0x01···=00000001···

ANTENNA, AND RADIO-FREQUENCY IDENTIFICATION TAG

CROSS-REFERENCE TO RELATED APPLICATION

This application claims the benefit of Japanese Patent Application No. 2007-048018, filed Feb. 27, 2007, the disclosure of which is incorporated herein by reference.

BACKGROUND OF THE INVENTION

1. Field of the Invention

The present invention relates to improvements of an antenna suitably used for a radio-frequency identification tag capable of writing and reading information in a non-contact fashion.

2. Description of Related Art

There is known an RFID (Radio-Frequency Identification) communication system wherein a radio-frequency identification tag communication device (interrogator) reads out information, in a non-contact fashion, from small-sized radio-frequency identification tags (transponders) on which desired information is written. In this RFID communication system, the radio-frequency identification tag communication device is capable of reading out the information from the radio-frequency identification tags, even where the radio-frequency identification tags are contaminated or located at positions invisible from the radio-frequency identification tag communication device. For this reason, the RFID communication system is expected to be used in various fields, such as management and inspection of articles of commodity.

One of fundamental needs to be satisfied regarding the RFID communication system is to reduce the size of the radio-frequency identification tags. To reduce the size of the radio-frequency identification tags, it is particularly required to accommodate an antenna of each radio-frequency identification tag in a surface area as small as possible, while maintaining characteristics of the antenna desired for radio-frequency transmission and reception of information. An example of a structure of the antenna takes the form of a planar or flat meander line structure. JP-2004-228797A (corresponding to U.S. Pat. No. 7,109,945 B2) discloses an example of a planar antenna for television reception. This planar antenna has a planar meander line structure which includes line conductors formed in a meandering or zigzag pattern so that the antenna can be accommodated in a surface area as small as possible, while maintaining the desired characteristics such as a longitudinal dimension.

However, the size reduction of the radio-frequency identification tag has a problem specific to its construction. Namely, the size reduction of the radio-frequency identification tag results in reduction of an input impedance of its antenna, and an increase of a degree of mismatch between the input impedance of the antenna and an input impedance of an IC circuit portion connected to the antenna, so that there is a risk of deterioration of the characteristics of the antenna such as its sensitivity value and communication distance. Therefore, there have been a need for developing a small-sized antenna which has a good impedance match with the IC circuit portion and which maintains desired communication characteristics, and a need for developing a radio-frequency identification tag provided with such a small-sized antenna.

SUMMARY OF THE INVENTION

The present invention was made in view of the background art described above. It is a first object of this invention to provide a small-sized antenna which has a good impedance match with a circuit portion and which maintains desired communication characteristics. A second object of this invention is to provide a radio-frequency identification tag provided with such a small-sized antenna.

The first object indicated above can be achieved according to a first aspect of the present invention, which provides an antenna connected to a circuit portion and configured to effect transmission and reception of information by radio communication, the antenna comprising a driven meander line portion which has a feed section connected to the circuit portion and which is a line conductor formed in a meandering pattern, and a parasitic meander line portion which does not have a feed section connected to the circuit portion and which is a line conductor formed in a meandering pattern, the parasitic meander line portion being positioned relative to the driven meander line portion, so as to influence an input impedance of the driven meander line portion, wherein the driven and parasitic line portions have respective extensions of the line conductors formed at respective opposite longitudinal ends of the antenna.

The antenna constructed according to the present invention as described above includes the driven meander line portion which has the feed sections connected to the IC circuit portion and which is a line conductor formed in a meandering pattern, and the parasitic meander line portion which does not have a feed section connected to the IC circuit portion and which is a line conductor formed in a meandering pattern, and positioned relative to the driven meander line portion, so as to influence the input impedance of the driven meander line portion. Accordingly, the input impedance of the driven meander line portion can be made close to the input impedance of the IC circuit portion, by suitably positioning the driven and parasitic meander line portions. Accordingly, a radio-frequency identification tag provided with the antenna can be small-sized, with a minimum matching loss of the input impedance of the driven meander line portion with that of the IC circuit portion, and with minimum deterioration of the communication characteristics of the antenna such as the communication sensitivity and maximum communication distance. In addition, the provision of the extensions at the respective opposite ends of the driven and parasitic meander line portions (at the respective opposite ends of the antenna) makes it possible to increase the total lengths of the meander line portions while ensuring a comparatively high electric current density without having to increase the overall size of the antenna, thereby permitting a comparatively low resonant frequency of the antenna. That is, the present embodiment provides the small-sized antenna which has a good impedance match with the IC circuit portion and which maintains the desired communication characteristics.

According to a first preferred form of the first aspect of this invention, each of the extensions of the driven and parasitic meander line portions is formed at a longitudinal end part of the corresponding meander line portion in which a density of an electric current is higher than at the other longitudinal end part, during information transmission and reception through the antenna. In this form of the invention, the length of each of the driven and parasitic meander line portions in which the electric current density is sufficiently high can be increased, making it possible to lower the resonant frequency of the antenna.

According to a second preferred form of the first aspect of the invention, the extensions of the driven and parasitic meander line portions have a same length, so that the resonant frequency of the antenna can be lowered.

According to a third preferred form of the invention, each of the driven and parasitic meandering portions includes a plurality of transverse conductive sections and a plurality of longitudinal conductive sections, which are alternately arranged in a longitudinal direction of the antenna, and are alternately connected to each other so as to form the meandering pattern, such that a distance in the longitudinal direction between the adjacent transverse conductive sections of the driven meander line portion and a distance between the adjacent transverse conductive sections of the parasitic meander line portion, in longitudinal parts of the driven and parasitic meander line portions corresponding to the extensions, are smaller than those in the other longitudinal parts of the meandering portions. In this form of the invention, the required longitudinal dimension of the antenna can be minimized.

According to a fourth preferred form of the invention, the driven and parasitic meander line portions include respective large-width parts in respective longitudinal and transverse parts thereof in which a density of an electric current is higher in the other longitudinal and transverse parts during communication through the antenna, the driven and parasitic meander line portions having a larger width dimension in the large-width parts than in the above-indicated other longitudinal parts. The provision of the large-width parts of the meander line portions in the above-indicated longitudinal parts permits radio communication at a comparatively low resonant frequency while minimizing a loss in the longitudinal and transverse parts of the meander line portions in which the electric current density is comparatively high.

In an advantageous arrangement of the above-indicated third or fourth preferred form of the invention, the parasitic meander line portion includes at least one pair of adjacent transverse conductive sections each of which does not include the extension and each of which is interposed between a pair of adjacent transverse conductive sections of the driven meander line portion, which pair corresponds to the above-indicated each pair of adjacent transverse conductive sections of the parasitic meander line portion and does not include the extension. In this arrangement wherein the adjacent transverse conductive sections of the parasitic meander line portion not including the extension are interposed between the corresponding adjacent transverse sections of the driven meander line portion, an apparatus provided with the antenna can be small-sized while ensuring the desired characteristics of the apparatus such as its sensitivity and maximum communication distance.

The second object indicated above can be achieved according to a second aspect of this invention, which provides a radio-frequency identification tag for radio communication with a radio-frequency identification tag communication device, the radio-frequency identification tag including an antenna constructed according to the above-described first aspect of this invention, wherein the circuit portion is an IC circuit portion having a memory portion for storing predetermined information.

The radio-frequency identification tag constructed according to the second aspect of this invention described above is provided with the antenna constructed according to the first aspect of the invention. Accordingly, the radio-frequency identification tag can be small-sized, with a minimum matching loss of the input impedance of the driven meander line portion with that of the IC circuit portion, and with minimum deterioration of the communication characteristics of the antenna such as the communication sensitivity and maximum communication distance. In addition, the provision of the extensions at the respective opposite ends of the driven and parasitic meander line portions (at the respective opposite ends of the antenna) makes it possible to increase the total lengths of the meander line portions while ensuring a comparatively high electric current density without having to increase the overall size of the antenna, thereby permitting a comparatively low resonant frequency of the antenna. That is, the present embodiment provides the small-sized radio-frequency identification tag which has a good impedance match with the IC circuit portion and which maintains the desired communication characteristics.

Preferably, the driven and parasitic meander line portions of the antenna of the radio-frequency identification tag are formed on opposite surfaces of a film member of an electrically insulating material. In this case, the parasitic meander line portion can be suitably positioned relative to the driven meander line portion so as to influence the input impedance of the driven meander line portion.

BRIEF DESCRIPTION OF THE DRAWING

The above and other objects, features and industrial significance of this invention will be better understood by reading the following detailed description of the preferred embodiments of the invention, when considered in connection with the accompanying drawings in which.

DETAILED DESCRIPTION OF THE PREFERRED EMBODIMENTS

The preferred embodiments of the present invention will be described in detail by reference to the drawings.

Figure 1:
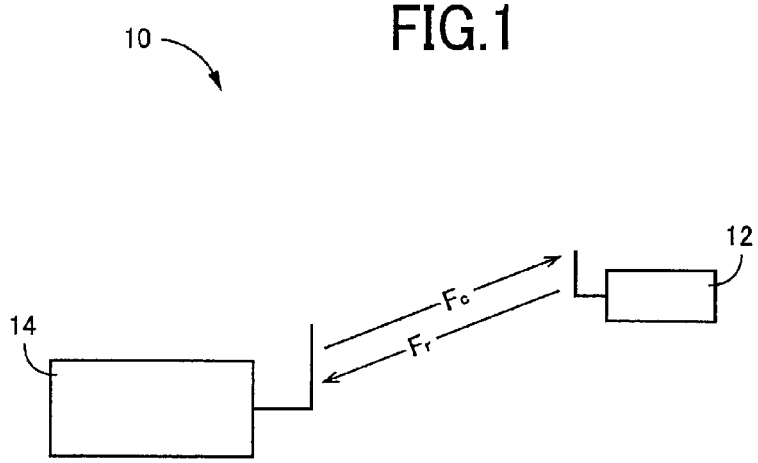
FIG. 1 is a view illustrating an RFID system including a radio-frequency identification tag in which a radio-frequency identification tag communication device effects radio communication with a radio-frequency identification tag provided with an antenna constructed according to the present invention.

Referring first to FIG. 1, there is illustrated a radio-frequency identification tag communication system 10 including at least one radio-frequency identification tag 12 (one tag 12 in the example of FIG. 1) each provided with an antenna 52 constructed according to the present invention, and a radio-frequency identification tag communication device 14 capable of effecting radio communication with each RFID tag 12. This radio-frequency identification tag communication system 10 is a so-called "RFID" (Radio-Frequency Identification) system in which each RFID tag 12 (hereinafter referred to as "RFID tag 12") functions as a transponder, while the radio-frequency identification tag communication device 14 functions as an interrogator. Described in detail, the radio-frequency identification tag communication device 14 is arranged to transmit an interrogating wave $F_c$ (transmitted signal) toward the RFID tag 12, and the RFID tag 12 which has received the interrogating wave $F_c$ modulates the received interrogating wave $F_c$ according to a predetermined information signal (data) to generate a reply wave $F_r$ (reply signal) to be transmitted toward the radio-frequency identification tag communication device 14, whereby radio communication is effected in a non-contact fashion between the RFID tag 12 and the radio-frequency identification tag communication device 14, such that the radio-frequency identification tag communication device 14 reads out and/or writes information from or on the RFID tag 12.

Figure 2:
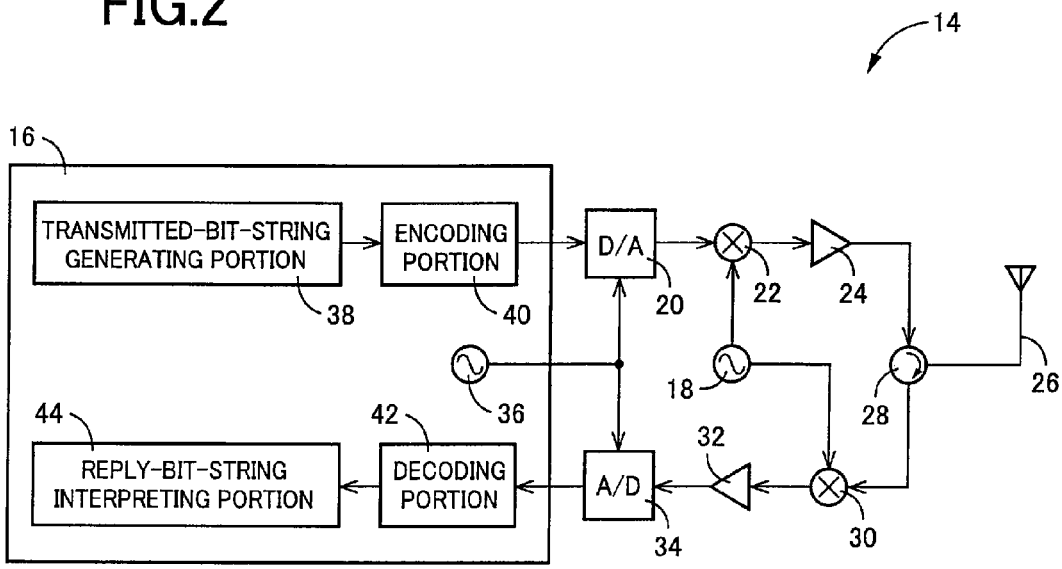
FIG. 2 is a view illustrating an arrangement of the radio-frequency identification tag communication device of the RFID system of FIG. 1.

The radio-frequency identification tag communication device 14 is arranged to effect radio communication with the radio-frequency identification tag 12, for performing at least one of the information reading from and the information writing on the radio-frequency identification tag 14. As shown in FIG. 2, the radio-frequency identification tag communication device 14 includes a DSP (Digital Signal Processor) 16, a carrier generating portion 18, transmitter D/A converting portion 20, a transmitter mixer 22, a transmitter amplifier 24, a transmitter/receiver antenna 26, a transmission/reception separating portion 28, a receiver mixer 30, a receiver amplifier 32, and a receiver A/D converting portion 34. The DSP 16 is configured to perform digital signal processing operations for generating the transmitted signal in the form of a digital signal and decoding the reply signal received from the RFID tag 12. The carrier generating portion 18 is configured to a signal of a predetermined frequency corresponding to the carrier wave of the interrogating wave $F_c$ indicated above. The transmitter D/A converting portion 20 is configured to convert the digital transmitted signal generated by the DSP 16, into an analog signal. The transmitter mixer 22 is configured to amplitude-modulate the carrier wave signal generated by the carrier generating portion 18, according to the transmitted analog signal received from the transmitter D/A converting portion 20. The transmitter amplifier 24 is configured to amplify the signal modulated carrier wave signal generated by the transmitter mixer 22. The transmitter/receiver antenna 26 is configured to transmit, as the interrogating signal $F_c$, the modulated carrier wave signal received from the transmitter amplifier 24, toward the RFID tag 12, and to receive the reply wave $F_r$ transmitted from the RFID tag 12 in response to the interrogating wave $F_c$. The transmission/reception separating portion 28 is configured to apply the modulated carrier wave signal received from the transmitter amplifier 24, to the transmitter/receiver antenna 26, and to apply the received signal received from the transmitter/receiver antenna 26, to the receiver mixer 30. The receiver mixer 30 is configured to multiply the received signal received from the transmitter/receiver antenna 26 through the transmission/reception separating portion 28, by the carrier wave signal received from the carrier generating portion 18, and to effect homodyne or orthogonal detection of the received signal by eliminating a high-frequency component by a filter. The receiver amplifier 32 is configured to amplify the received signal received from the receiver mixer 30. The receiver A/D converting portion 34 is configured to convert an output of the receiver mixer 32 29 into a digital signal, and to apply the digital signal to the DSP 16. The transmission/reception separating portion 28 may be a circulator or a directional coupler. A low-noise amplifier configured to amplify the received signal may be disposed between the transmission/reception separating portion 28 and the receiver mixer 30.

The DSP 16 described above is a so-called microcomputer system incorporating a CPU, a ROM and a RAM and configured to be operable to perform signal processing operations according to programs stored in the ROM, while utilizing a temporary data storage function of the RAM. The DSP 16 is provided with functional components including a sampling-frequency generating portion 36, a transmitted-bit-string generating portion 38, an encoding portion 40, a decoding portion 42, and a reply-bit-string interpreting portion 44. The sampling-frequency generating portion 36 is configured to generate a sampling frequency used by the above-described transmitter D/A converting portion 20 and receiver A/D converting portion 34. The transmitted-bit-string generating portion 38 is configured to generate a command bit string corresponding to the transmitted signal to be transmitted to the RFID tag 12. The encoding portion 40 is configured to encode a digital signal generated by the transmitted-bit-string generating portion 38, according to a pulse-width method, and to apply the encoded signal to the transmitter D/A converting portion 20. The decoding portion 42 is configured to FM-decode the signal (demodulated signal) received from the receiver A/D converting portion 34. The reply-bit-string interpreting portion 44 is configured to interpret the decoded signal generated by the decoding portion 42, and to read out the information relating to the modulation by the RFID tag 12.

Figure 3:
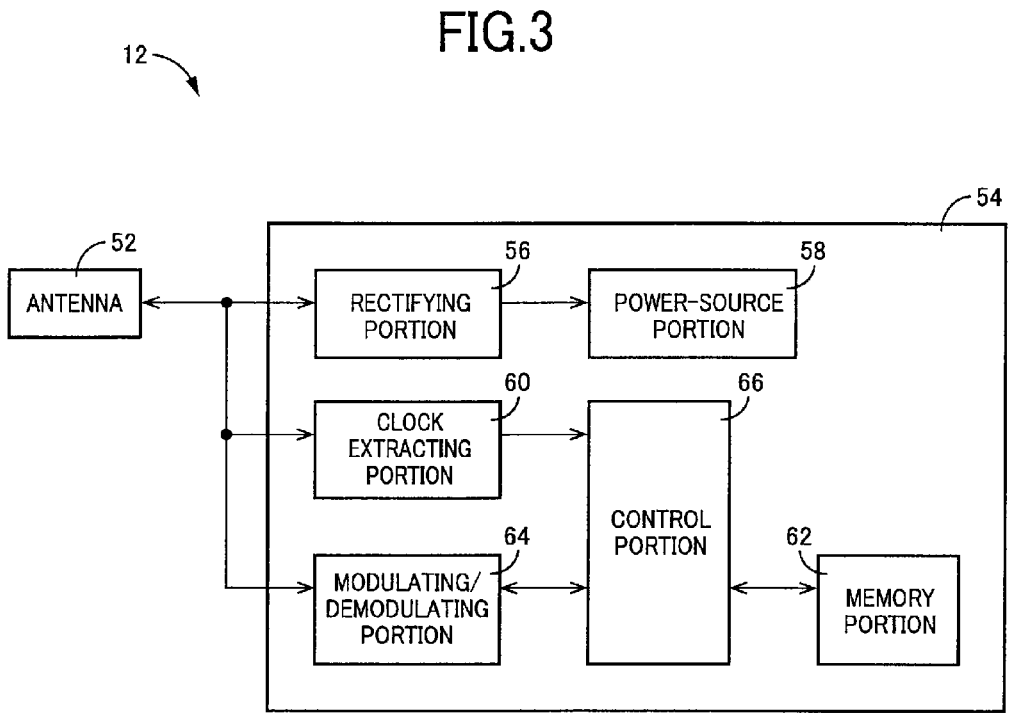
FIG. 3 is a view illustrating an arrangement of the radio-frequency identification tag constructed according to one embodiment of this invention.

Referring to FIG. 3, there is illustrated an arrangement of the above-described RFID tag 12. As shown in FIG. 3, the RFID tag 12 includes an antenna 52 constructed according to one embodiment of this invention, and an IC circuit portion 54 connected to the antenna 52 and configured to process the signal transmitted from the radio-frequency identification tag communication device 14 and received from the antenna 52. The IC circuit portion 54 includes: a rectifying portion 56 to rectify the interrogating wave $F_c$ received from the radio-frequency identification tag communication device 14 through the antenna 52; a power-source portion 58 for storing an energy of the interrogating wave $F_c$ rectified by the rectifying portion 56; a clock extracting portion 60 for extracting a clock signal from the carrier wave received through the antenna 52 and applying the clock signal to a control portion 66; a memory portion 62 functioning as an information storing portion capable of storing desired information signals; a modulating/demodulating portion 64 connected to the above-described antenna 52 and configured to effect signal modulation and demodulation; and the control portion 66 for controlling the above-described rectifying portion 56, clock extracting portion 60, modulating/demodulating portion 64, etc., to control the operation of the RFID tag 12. The control portion 66 performs basic control operations such as a control operation to store the desired information in the memory portion 62 by communication with the radio-frequency identification tag communication device 14, and a control operation to control the modulating/demodulating portion 64 for modulating the interrogating wave $F_c$ received through the antenna 52 on the basis of the information signals stored in the memory portion 62, and transmitting the reply wave $F_r$, as a reflected wave, through the antenna 52.

Figure 4:
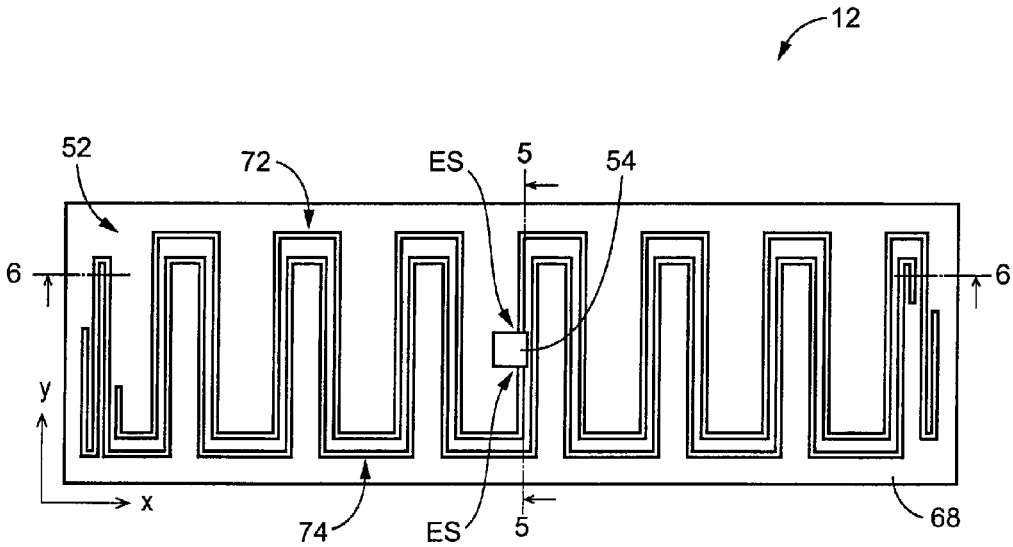
FIG. 4 is a plan view of the radio-frequency identification tag of FIG. 3.
Figure 5:
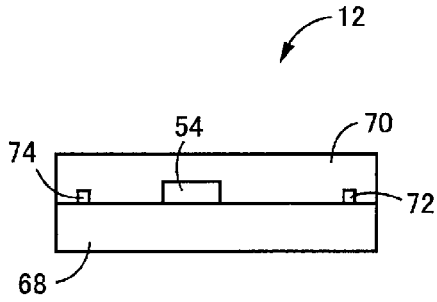
FIG. 5 is a cross sectional view taken along line 5-5 of FIG. 4.
Figure 6:
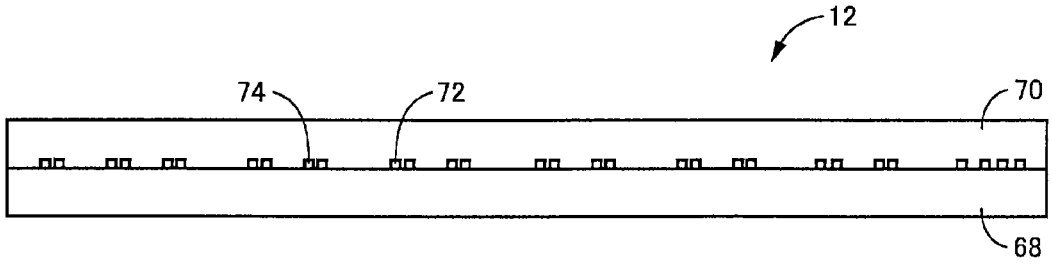
FIG. 6 is a cross sectional view taken along line 6-6 of FIG. 4.

Referring to the plan view of FIG. 4 and the cross sectional views of FIGS. 5 and 6, there is shown an arrangement of the IC circuit portion 54 of the antenna 52 of the RFID tag 12. As shown in FIGS. 4 and 5, the IC circuit portion 54 is formed on one surface of a substrate 68 in the form of a film of a suitable material such as PET (polyethylene terephthalate). As shown in FIGS. 5 and 6, the surface of the substrate 68 on which the IC circuit portion 54 is formed is covered by a protective layer 70 formed of a suitable material such as PET, to protect the antenna 52 and the IC circuit portion 54. The antenna 52 includes a driven meander line portion 72 and a parasitic meander line portion 74 which are line conductors formed in a meandering pattern. The driven meander line portion 72 has feed sections ES connected to the IC circuit portion 54, while the parasitic meander line portion 74 does not have such feed sections ES. The parasitic meander line portion 74 is positioned relative to and spaced apart by a predetermined distance from the driven meander line portion 74 such that the parasitic meander line portion 74 is formed along the driven meander line portion 62 and influences an input impedance of the driven meander line portion 72. The meandering pattern indicated above, which may be a serpentine pattern, is a succession of unit forms such as letter-S shapes, rectangular waves, and almost-rectangular waves having chamfered corners. The unit forms are arranged at a predetermined pitch in the longitudinal direction of the substrate 68 (RFID tag 12). In the present specific example of FIGS. 4-6, the meandering pattern is the rectangular wave pattern. Preferably, the parasitic meander line portion 74 is electrically insulated from the driven meander line portion 72.

Figure 7:
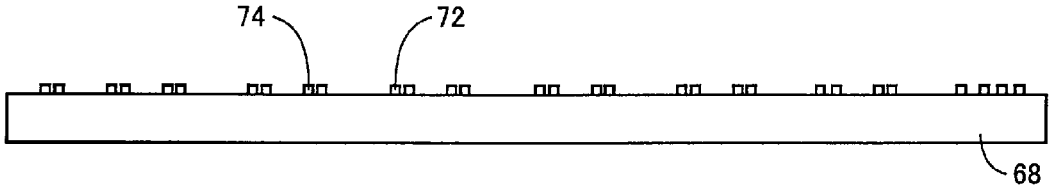
FIG. 7 is a view corresponding to that of FIG. 6, showing the radio-frequency identification tag of FIG. 3 not provided with a protective layer.

Each of the driven and parasitic meander line portions 72, 74 formed on the surface of the substrate 68 as shown in FIG. 7 is a thin strip or band of a suitable electrically conductive material such as copper, aluminum and silver, which has a width of about 0.1-3.0 mm (about 0.5 mm in this specific example) and a thickness of about 1-100 μm (16 μm in this specific example) and which is formed by a suitable forming technique such as a metal-foil or thin-film forming process, or a printing process (using a paste of silver or copper, for example). The thus formed driven and parasitic meander line portions 72, 74 are covered by the protective layer 70, as shown in FIGS. 5 and 6. Preferably, a printing operation is performed on the surface of the protective layer 70, to provide the RFID tag 12 with a printed representation indicative of the type of the RFID tag 12 and the contents of information stored in the memory portion 62, and the back surface of the substrate 68 is provided with an adhesive layer by which the RFID tag 12 is attached to a desired object such as an article of commodity, for management of the desired object by communication between the radio-frequency identification tag communication device 14 and the RFID tag 12.

Figure 8:
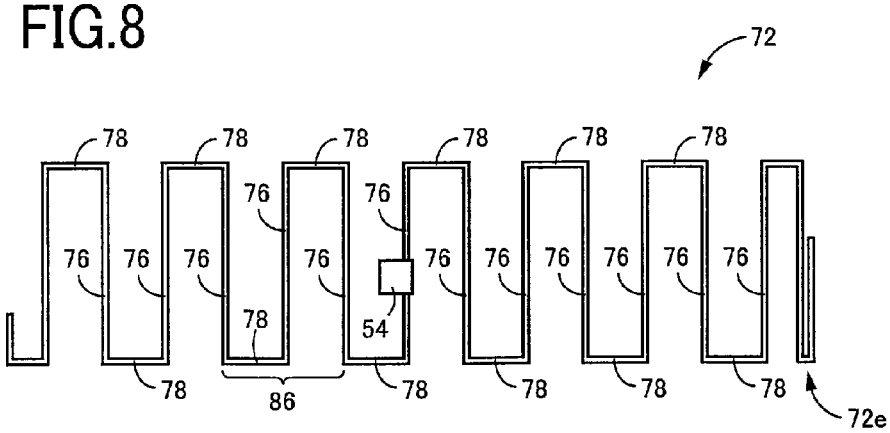
FIG. 8 is a view showing in detail an arrangement of a driven meander line portion of the antenna of the radio-frequency identification tag of FIG. 4.
Figure 9:
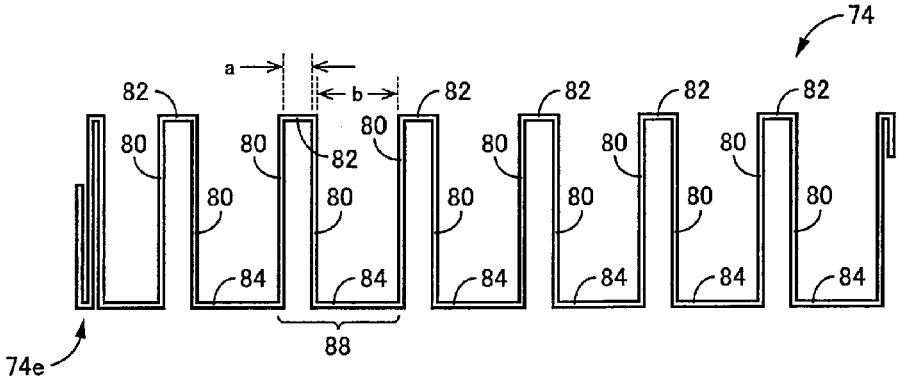
FIG. 9 is a view showing in detail an arrangement of a parasitic meander line portion of the antenna of the radio-frequency identification tag of FIG. 4.

FIG. 8 shows in detail an arrangement of the driven meander line portion 72, while FIG. 9 shows in detail an arrangement of the parasitic meander line portion 74. As shown in FIG. 8, the driven meander line portion 72 consists of a plurality of mutually parallel and straight transverse conductive sections 76 and a plurality of straight longitudinal conductive sections 78 which are alternately arranged and connected to each other so as to form a meandering or serpentine pattern. The transverse conductive sections 76 extend in the width or transverse direction of the antenna 52 (in a "y" direction indicated in FIG. 4), while the longitudinal conductive sections 78 extend in the length or longitudinal direction of the antenna 52 (in an "x" direction indicated in FIG. 4) so as to connect corresponding ends of the adjacent two transverse conductive sections 76. The IC circuit portion 54 is connected to a selected one of the plurality of transverse conductive sections 76 of the driven meander line portion 72, preferably, to a centrally located one of the transverse conductive sections 76 as seen in the longitudinal direction of the antenna 52. As shown in FIG. 9, on the other hand, the parasitic meander line portion 74 consists of a plurality of mutually parallel and straight transverse conductive sections 80 and a plurality of straight longitudinal conductive sections 82, 84, which sections 80, 82, 84 are alternately connected to each other so as to form a meandering or serpentine pattern. The transverse conductive sections 80 extend in the transverse direction of the antenna 52, while the longitudinal conductive sections 82, 84 extend in the longitudinal direction of the antenna 52. The longitudinal conductive sections 82, 84 consist of short sections 82 and long sections 84 which respectively have relatively small and large lengths in the longitudinal direction. Namely, each short section 82 connecting the adjacent two transverse conductive sections 80 which are spaced apart from each other by a relatively small distance has a length "a" while each long section 84 connecting the adjacent two transverse conductive sections 80 which are spaced apart from each other by a relatively large distance has a length "b", as indicated in FIG. 9. The lengths "a" and "b" of the short and long longitudinal conductive sections 82, 84 are determined such that a ratio a/b is 1/2.6 (5/13). Thus, the driven meander line portion 72 has a succession of meander unit forms 86 arranged at a predetermined pitch in the longitudinal direction of the antenna 52, while the parasitic meander line portion 74 has a succession of meander unit forms 88 arranged at a predetermined pitch in the longitudinal direction. All of the meander unit forms 86 have the same dimension in the longitudinal direction of the antenna 52, and all of the meander unit forms 88 have the same dimension in the longitudinal direction. The driven meander line portion 72 and the parasitic meander line portion 74 have respective extensions 72*e*, 74*e* at respective longitudinally opposite ends of the antenna 52, as shown in FIGS. 8 and 9. These extensions 72*e*, 74*e* will be further described by reference to FIGS. 11 and 12.

Figure 10:
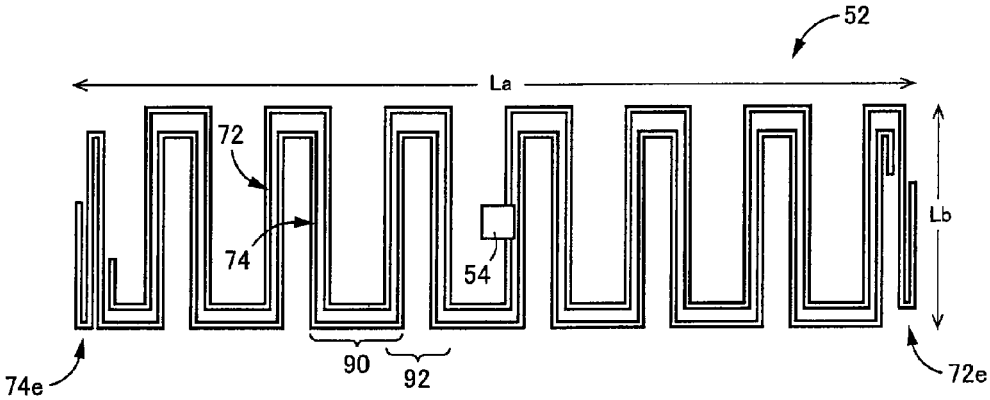
FIG. 10 is a view showing in detail an arrangement of the antenna of the radio-frequency identification tag of FIG. 4.

Referring next to FIG. 10, there is shown in detail an arrangement of the antenna 52. As shown in this figure, the antenna 52 has a longitudinal dimension La of about 67 mm, and a width dimension Lb of about 18.5 mm, for example. That is, a total dimension of the longitudinal conductive sections 78 of the driven meander line portion 72 in the longitudinal direction is larger than the length of the transverse conductive sections 76, and a total dimension of the longitudinal conductive sections 82, 84 of the parasitic meander line portion 74 in the longitudinal direction is larger than the length of the transverse conductive sections 80. The driven and parasitic meander line portions 72, 74 are dimensioned and positioned relative to each other such that the upper longitudinal conductive section 78 of the driven meander line portion 72 and the corresponding upper longitudinal conductive section 82 of the parasitic meander line section 74 as seen in FIG. 10 have a distance of about 0.5 mm therebetween in the transverse direction of the antenna 52, and such that the transverse conductive sections 76, 80 have the same distance of about 0.5 mm in the longitudinal direction of the antenna 52. That is, the distances between the driven and parasitic meander line portions 72, 74 are minimized to assure electrically insulation between these two meander line portions 72, 74. Further, the driven meander line portion 72 and the parasitic meander line portion 74 have respective different total lengths (conductive path lengths). Namely, the driven meander line portion 72 has a total length of about 306 mm, while the parasitic meander line portion 74 has a total length of about 315 mm. Preferably, the total length (conductive path length) of each of the two meander line portions 72, 74 is at least ½ of a wavelength of the carrier wave of an electromagnetic wave in the form of the above-described interrogating wave $F_c$ used for radio communication between the RFID tag 12 and the radio-frequency identification tag communication device 14.

In the parasitic meander line portion 74 described above, the short longitudinal conductive section 82 connecting the upper ends of the adjacent two transverse conductive sections 80 which are spaced apart from each other by the relatively small distance, and the long longitudinal conductive section 84 connecting the upper ends of the adjacent two transverse conductive sections 80 which are spaced apart from each other by the relatively large distance have the respective different lengths "a" and "b". Namely, the adjacent two transverse conductive sections 80 have one of two different distances in the longitudinal direction of the antenna 52. In the driven meander line portion 72, all of the longitudinal conductive sections 78 have the same length in the longitudinal direction. Namely, the adjacent two transverse conductive sections 76 have a single distance in the longitudinal direction. Thus, the meander unit forms 86 of the driven meander line portion 72 and the meander unit forms 88 of parasitic meander line portion 74 have different shapes even if those two unit forms 86, 88 are elongated or shortened in the longitudinal direction of the antenna 52 by respective different ratios. Accordingly, the driven meander line portion 72 and the parasitic meander line portion 74 can be positioned relative to each other within a minimum surface area in the same plane, as shown in FIG. 10, such that the two meander line portions 72, 74 are electrically insulated from each other.

As also shown in FIG. 10, the driven meander line portion 72 and the parasitic meander line portion 74 are positioned relative to each other so as to define a plurality of first parts 90 and a plurality of second parts 92 which are arranged at a predetermined pitch in a predetermined positional relationship with each other in the longitudinal direction of the antenna 52. In each first part 90, a center-to-center distance between the adjacent two transverse conductive sections 80 of each meander unit form 88 of the parasitic meander line portion 72 minus the width dimensions of the adjacent two transverse conductive sections 80 is larger than a sum of a center-to-center distance between the adjacent two transverse conductive sections 76 of the driven meander line portion 72 and the width dimensions of the adjacent two transverse conductive sections 76. In each second part 92, a sum of the center-to-center distance between the adjacent two transverse conductive sections 80 of the meander unit form 88 and the width dimensions of the adjacent two transverse conductive sections 80 is smaller than the above-indicated center-to-center distance between the adjacent two transverse conductive sections 76 minus the width dimensions of the adjacent two transverse conductive sections 76. The center-to-center distance is a distance between the widthwise center lines of the adjacent two transverse conductive sections 76, 80. In each second part 92 described above, the adjacent two transverse conductive sections 80 of the parasitic meander line portion 74 are interposed between the corresponding adjacent two transverse conductive sections 76 of the driven meander line portion 72, in the longitudinal direction of the antenna 52. In each first part 90, the adjacent two transverse conductive sections 76 are interposed between the corresponding adjacent two transverse conductive sections 80 in the longitudinal direction of the antenna 52. In the example of FIG. 10, the driven and parasitic meander line portions 72, 74 have a total of six first parts 90 and a total of six second parts 92. Thus, the antenna 52 is provided with the driven meander line portion 72 and the parasitic meander line portion 74 which are positioned relative to each other, so as to define the first and second parts 90, 92 such that the adjacent two transverse conductive sections 80 of the parasitic meander line portion 74 are located nearer to one of the adjacent two transverse conductive sections 76 between which the adjacent two transverse conductive sections 80 are interposed.

Figure 11:
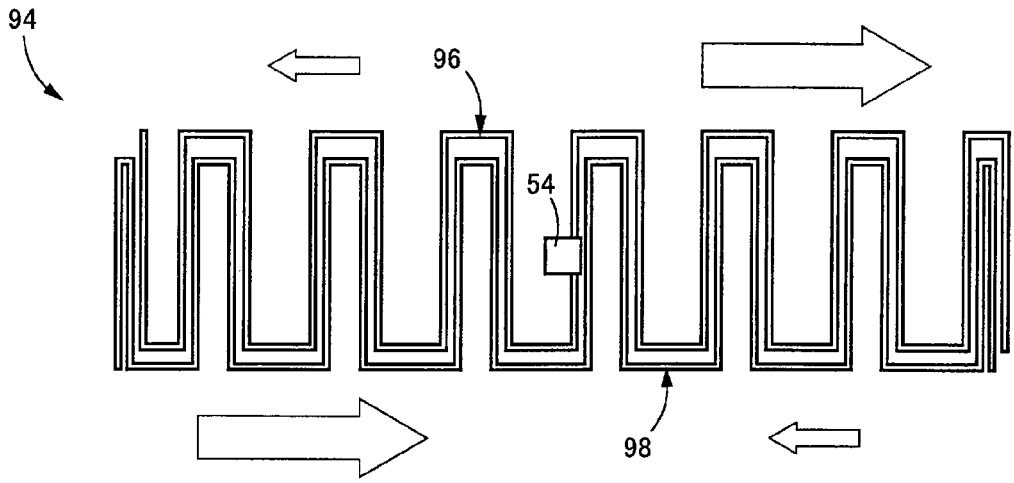
FIG. 11 is a view which shows a comparative antenna including driven and parasitic meander line portions not having extensions, and which explains a distribution of an electric current density during use of the comparative antenna.

FIG. 11 shows a comparative antenna 94 including a driven meander line portion 96 not having the extension 72*e* and a parasitic meander line portion 98 not having the extension 74*e*, and explains a distribution of a current density during use of the comparative antenna 94. As shown in FIG. 11, the driven meander line portion 96 and the parasitic meander line portion 98 of this comparative antenna 94 are line conductors formed in a meandering pattern. The driven meander line portion 96 has feed section connected to the IC circuit portion 54, while the parasitic meander line portion 98 does not have such feed sections. The parasitic meander line portion 98 is positioned relative to and spaced apart by a predetermined distance from the driven meander line portion 96 such that the parasitic meander line portion 98 is formed along the driven meander line portion 96 and influences an input impedance of the driven meander line portion 96. The comparative antenna 94 is substantially identical with the antenna 52 according to the present embodiment, except in that the driven and parasitic meander line portions 86, 98 do not have the above-described extensions 72*e*, 74*e*, and do not have cutout parts 72l, 74l (described below by reference to FIG. 11) which respectively correspond to the extensions 742, 72*e*. The driven meander line portion 96 is formed substantially symmetrically with respect to the IC circuit portion 54, that is, in a point-symmetric relation with the IC circuit portion 54 (rotated by 180° relative to the IC circuit portion 54), while the parasitic meander line portion 98 is formed in a substantially line-symmetric relation with a longitudinally centrally positioned one of the lower longitudinal conductive sections which is located below the IC circuit portion 54. This comparative antenna 94 suffers from an uneven distribution of the electric current density during communication through the antenna 94. Namely, the electric current flowing through the comparative antenna 94 tends to have a high-density part and a low-density part during the communication. In FIG. 11, upper arrows indicate the electric current density of the driven meander line portion 96, while lower arrows indicate the electric current density of the parasitic meander line portion 98. The size of the arrows indicates the value of the electric current density. That is, the comparatively large arrows represent the comparatively high electric current density, while the comparatively small arrows represent the comparatively low electric current density.

Figure 12:
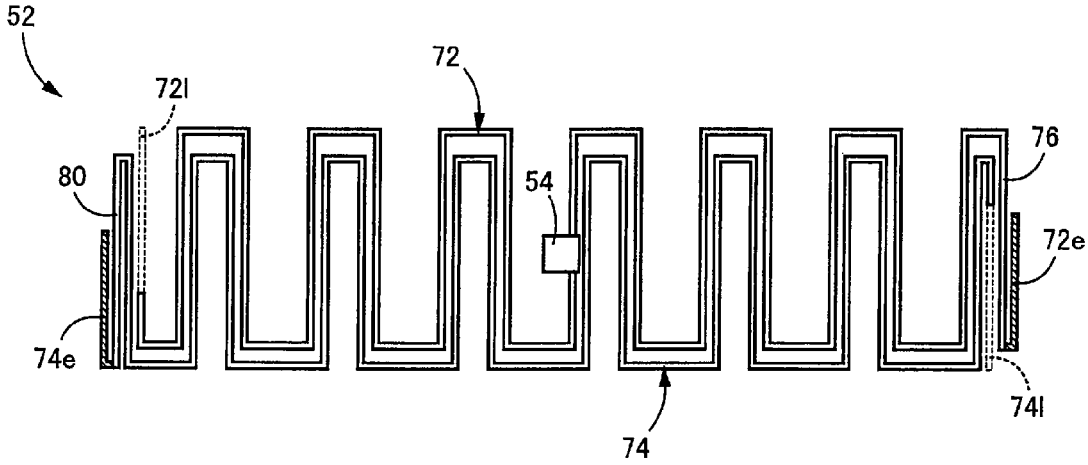
FIG. 12 is a view which explains the extensions of the meander line portions of the antenna of the radio-frequency identification tag of FIG. 4, and which shows cutout parts corresponding to the extensions.

As described above, the driven and parasitic meander line portions 72, 74 of the antenna 52 according to the present embodiment of the invention have the respective extensions 72*e*, 74*e* formed at the respective longitudinally opposite ends of the antenna 52. Preferably, each of the extensions 72*e*, 74*e* is a line conductor formed at the longitudinal end part of the corresponding meander line portion 72, 74 in which the electric current density is comparatively higher than at the other longitudinal end part, during information transmission and reception through the antenna 52. Namely, the extensions 72*e*, 74*e* are formed at the respective longitudinal ends of the driven and parasitic meander line portions 72, 74 which ends correspond to the large arrows shown in FIG. 11. The lengths of the extensions 72*e*, 74*e* extending from the above-indicated longitudinal ends of the meander line portions 72, 74 are selected within a range of about 5-16% of the total lengths of the meander line portions 72, 74. As described below by reference to FIG. 13, the lengths of the extensions 72*e*, 74*e* shorter than 5% of the total lengths does not permit a sufficient amount of decrease of a resonant frequency fs2, while the lengths of the extensions 723, 74*e* longer than 16% of the total lengths undesirably cause the resonant frequency fs2 and a frequency fp1 to be close to each other, resulting in a large amount of variation of the input impedance of the antenna 52 at a frequency near the value fs2, and unstable matching of the input impedance. As is apparent from FIGS. 11 and 12, each of the meander line portions 72, 74 has the above-indicated cutout part 72l, 74l at its longitudinal end opposite to the longitudinal end at which the extension 72*e*, 74*e* is formed. The cutout parts 72l, 74l have the same lengths as the respective extensions 72*e*, 74*e*. In the cutout parts 72l, 74l, there exist no line conductors. Accordingly, the driven meander line portion 72 according to the present embodiment has the total length equal to that of the driven meander line portion 96 of the comparative antenna 94, while the parasitic meander line portion 74 according to the present embodiment has the total length equal to that of the parasitic meander line portion 98 of the comparative antenna 94. In other words, the antenna 52 according to the present embodiment is formed by modifying the comparative antenna 94 that is substantially symmetric with respect to the IC circuit portion 54, such that the end portions of the meander line portions 96, 98 of the comparative antenna 94 corresponding to the cutout parts 72l, 74l are removed, while the extensions 72*e*, 74*e* having the same lengths as the cutout parts 72l, 74l are formed at the other end portions of the meander line portions 96, 98 at which the electric current density is higher. Preferably, the extensions 72*e*, 74*e* of the driven and parasitic meander line portions 72, 74 have the same length. As shown in FIG. 12, the distance between the adjacent transverse conductive sections 76 including the extension 72*e* of the driven meander line portion 72 and the distance between the adjacent transverse conductive sections 80 including the extension 74*e* are smaller than the distances between the other adjacent transverse conductive sections 76, 80.

Figure 13:
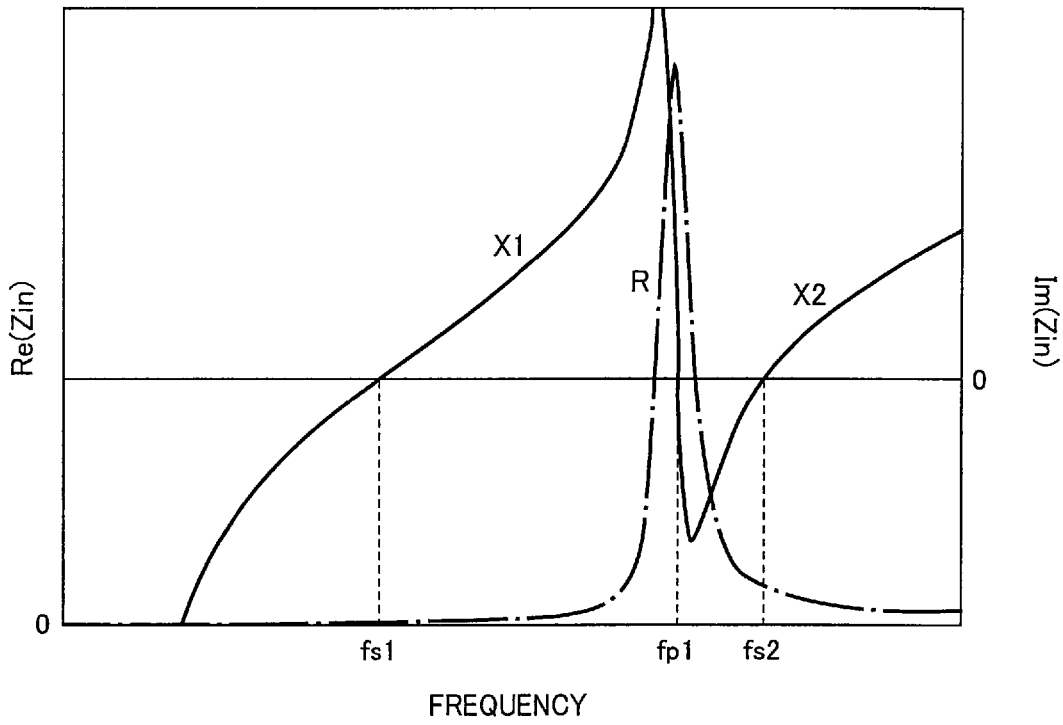
FIG. 13 is a graph for explaining an input impedance of the antenna of the radio-frequency identification tag of FIG. 4, wherein solid line curves represent resonant frequency while broken line curves represent resistance (radiation resistance)

Referring to FIG. 13 for explaining the input impedance of the antenna 52, solid line curves represent an imaginary component of the input impedance, that is, an admittance, while broken line curves represent a resistance (radiation resistance). Where the frequency at which the admittance (imaginary component) of the input impedance is zero is defined as the resonant frequency, the curves representative of series resonant frequency and curves representative of parallel resonant frequency (lines almost parallel to the vertical axis) are alternately located along the horizontal axis along which the frequency is taken, as indicated in FIG. 11. The frequency used for the radio communication of the RFID tag 12 with the radio-frequency identification tag communication device 14 is in the neighborhood of 800-950 MHz. At the frequency in this frequency band at which the imaginary component of the parallel resonant frequency is zero, the resistance component is substantially infinite. Regarding the curves representative of the series resonant frequency, the resistance represented by the curve R corresponding to the curve X1 representative of the lowest first resonant frequency is substantially zero at a frequency fs1 which the imaginary component of the series resonant frequency is zero. In this case, the antenna 52 is not operable in a satisfactory manner. However, the resistance represented by the curve R corresponding to the curve X2 representative of the second lowest resonant frequency is about 50Ω at the frequency fs2 at which the imaginary component of the series resonant frequency is zero. In this case, the antenna 52 has an input impedance high enough to permit the antenna 52 to be operated in a satisfactory manner. Thus, the antenna 52 according to the present embodiment has a plurality of resonant frequency values (series resonant frequency values) at which the imaginary component of the input impedance is zero. Accordingly, the antenna 52 of the RFID tag 12 can function in the intended manner, at the second, third, and subsequent resonant frequency values.

Figure 14:
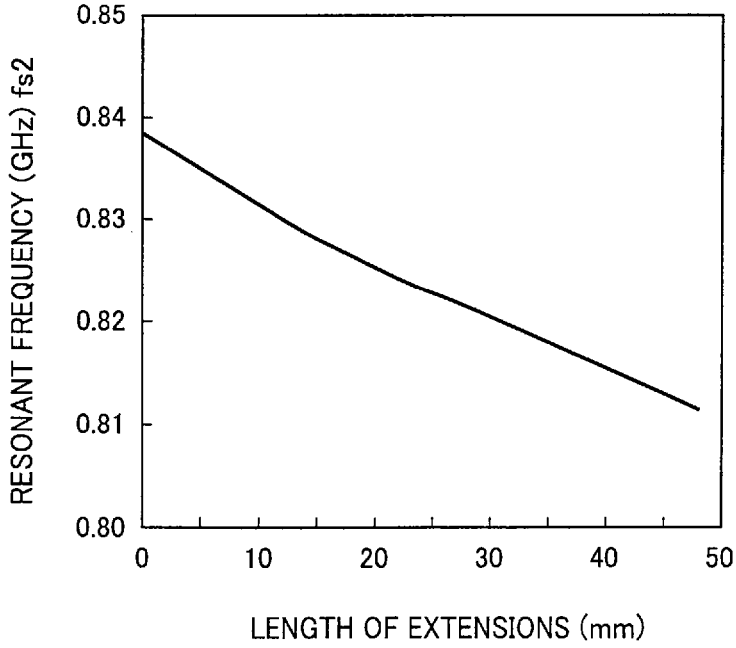
FIG. 14 is a graph indicating a change of second resonant frequency corresponding to the length of the extensions of the meander line portions of the antenna of the radio-frequency identification tag of FIG. 4.

FIG. 14 is a graph indicating a change of the second resonant frequency fs2 corresponding to the length of the extensions 72*e*, 74*e* of the meander line portions 72, 74 of the antenna 52. As indicated in FIG. 14, the second resonant frequency fs2 changes with the length of the extensions 72*e*, 74*e* (cutout parts 72l, 74l) provided on the antenna 52. Namely, the second resonant frequency fs2 decreases with an increase of the length of the extensions 72*e*, 74*e*. Therefore, a decrease of the second resonant frequency fs2 makes it possible to minimize the total lengths of the driven and parasitic meander line portions 72, 74, and the size (longitudinal or width dimension) of the antenna 52.

Figures 15, 16:
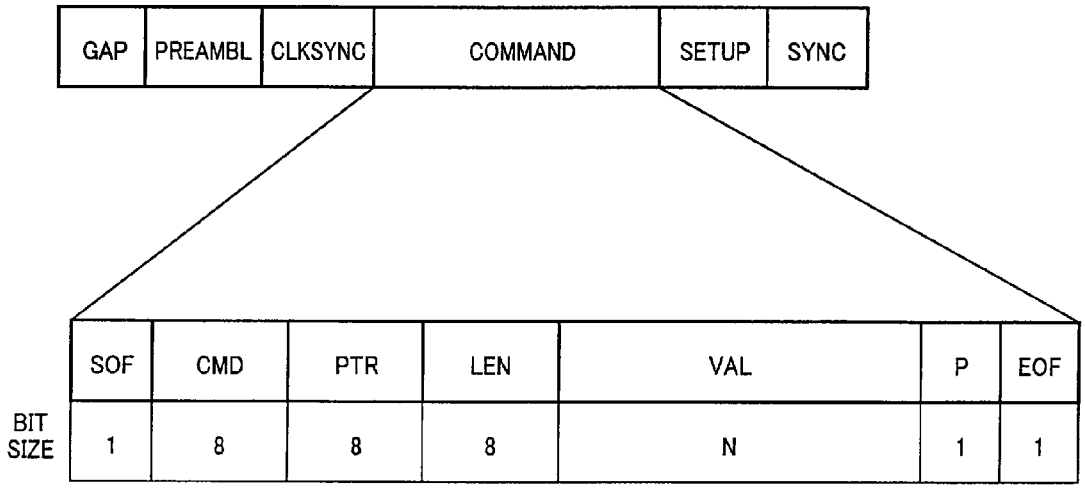
FIG. 15 is a view indicating commands used for radio communication with the radio-frequency identification tag of FIG. 3.
FIG. 16 is a view showing in detail a structure of a command frame generated by the radio-frequency identification tag communication device of FIG. 2.

There will next be described in detail the radio communication of the radio-frequency identification tag communication device 14 with the RFID tag 12. FIG. 15 indicates a plurality of commands used for the radio communication of the radio-frequency identification tag communication device 14 with the RFID tag 12. The communication to identify the desired RFID tag 12 uses commands such as "PING" and "SCROLL ID" for reading out the information stored in the RFID tag 12. The communication to write the information on the RFID tag 12 uses commands such as "ERASE ID" for initializing the information stored in the RFID tag 12, "PROGRAM ID" for information writing, "VERIFY" for verifying the information written, and "LOCK" for inhibiting writing of new information.

Referring to FIG. 16, there will be described in detail a structure of the command frame generated by the radio-frequency identification tag communication device 14. The above-described command frame uses unit time $T_0$ for transmission of one-bit information, and consists of "GAP" which is a $2T_0$ transmission power-off period, "PREAMBL" which is a $5T_0$ transmission power-on period, "CLKSYNC" for transmission of twenty "0" signals, "COMMAND" which are the contents of the commands, "SET UP" which is a $8T_0$ transmission power-on period, and "SYNC" for transmission of one "1" signal. The "COMMAND" which is interpreted by the RFID tag 12 consists of "SOF" indicating the start of the commands, "CMD" which are the commands indicated in FIG. 15, "PTR" which is a pointer specifying the memory address of the selected or desired RFID tag 12, "LEN" which indicates the length of the information to be written, "VAL" which is the content of information to be written, "P" which is parity information of "PTR", "LEN" and "VAL", and "EOF" which indicates the end of the commands.

Figure 17:
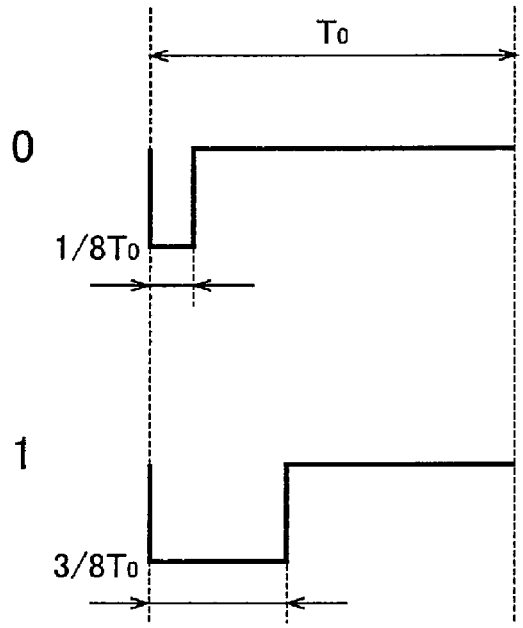
FIG. 17 is a view illustrating "0" signal and "1" signal which are elements of the command frame of FIG. 16.

The command frame described above is a series of elements consisting of the "0" and "1" signals indicated in FIG. 17, and the transmission power-on and power-off periods. For the operation to identify the desired RFID tag 12, or the operation to write the information thereon, the modulating information on the basis of the command frame is generated by the transmitted-bit-string generating portion 38 of the radio-frequency identification tag communication device 14, encoded by the encoding portion 40, modulated by the transmitter amplifier 24, and transmitted through the transmitter/receiver antenna 26 toward the RFID tag 12. The RFID tag 12 which receives the modulated information performs the information writing on the memory portion 62 and information replying operation, according to the commands under the control of the control portion 66.

Figure 18:
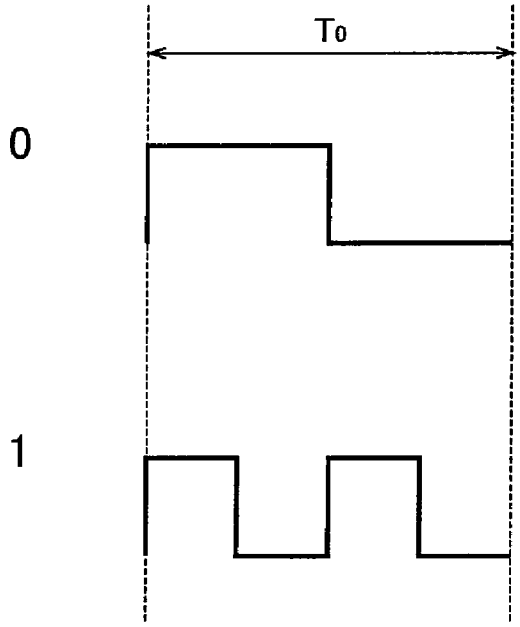
FIG. 18 is a view illustrating "0" signal and "1" signal used for generation of a reply signal transmitted from the radio-frequency identification tag of FIG. 3.
Figure 19:
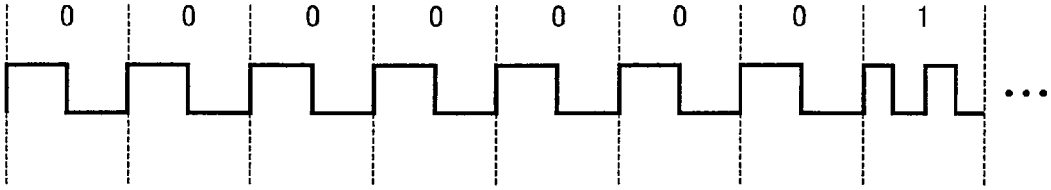
FIG. 19 is a view illustrating an example of an ID signal specific to the radio-frequency identification tag of FIG. 3.

In the information replying operation of the RFID tag 12, reply information discussed below in detail is constituted by a series of elements consisting of encoded "0" and "1" signals indicated in FIG. 18. On the basis of these signals, the carrier wave is reflection-modulated, and transmitted to the radio-frequency identification tag communication device 14. In the operation to identify the desired RFID tag 12, for instance, a reflected wave modulated according to an ID signal specific to the RFID tag 12, which is shown in FIG. 19 is transmitted to the radio-frequency identification tag communication device 14.

Figure 20:
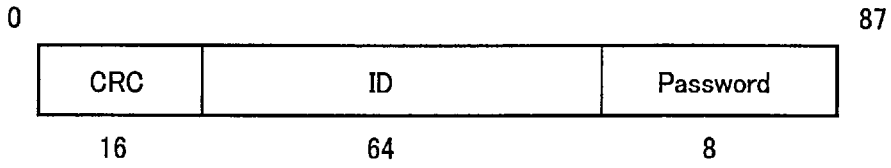
FIG. 20 is a view illustrating a memory structure of the radio-frequency identification tag of FIG. 3.
Figure 21:
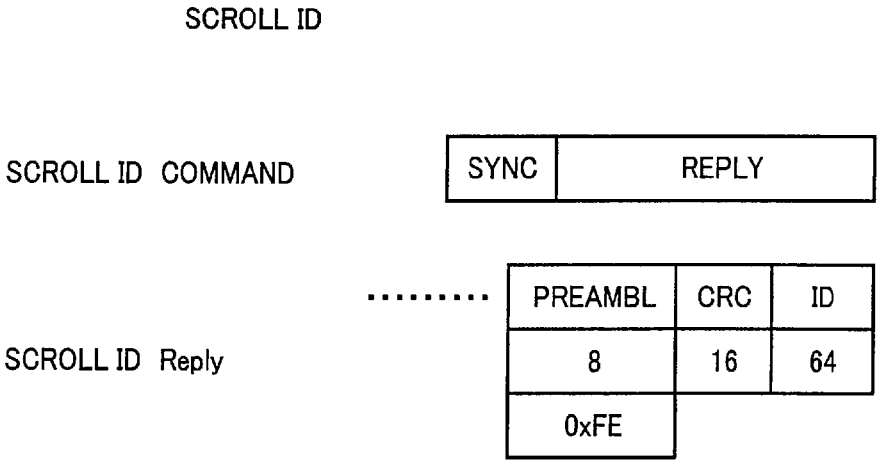
FIG. 21 is a view for explaining "SCROLL ID Reply" transmitted in response to a signal including a "SCROLL ID" command, when the signal is received by the radio-frequency identification tag of FIG. 3.

Referring to FIG. 20, there will be described an arrangement of the memory of the RFID tag 12. As shown in FIG. 20, the memory portion 62 stores a result of calculation of the CRC sign value, the ID specific to the RFID tag 12, and a password. When a signal including the "SCROLL ID" command as shown in FIG. 20 is received, the generated reply signal consists of the 8-bit "PREAMBL" signal represented by 0xFE, "CRC" representing the result of calculation of the CRC sign value stored in the memory portion 62, and the "ID" identifying the desired RFID tag 12.

Figure 22:
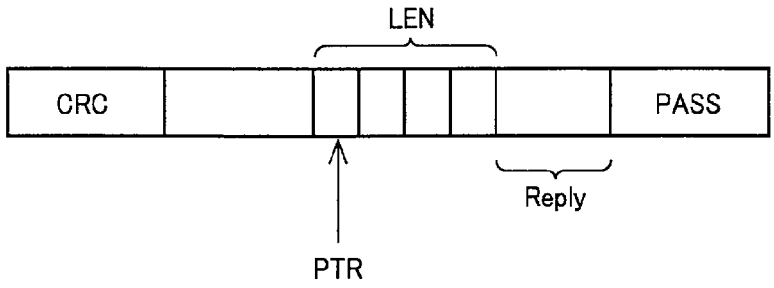
FIG. 22 is a view for explaining extraction of information following "LEN" which is a part of the information stored in a memory portion shown in FIG. 3.
Figure 23:
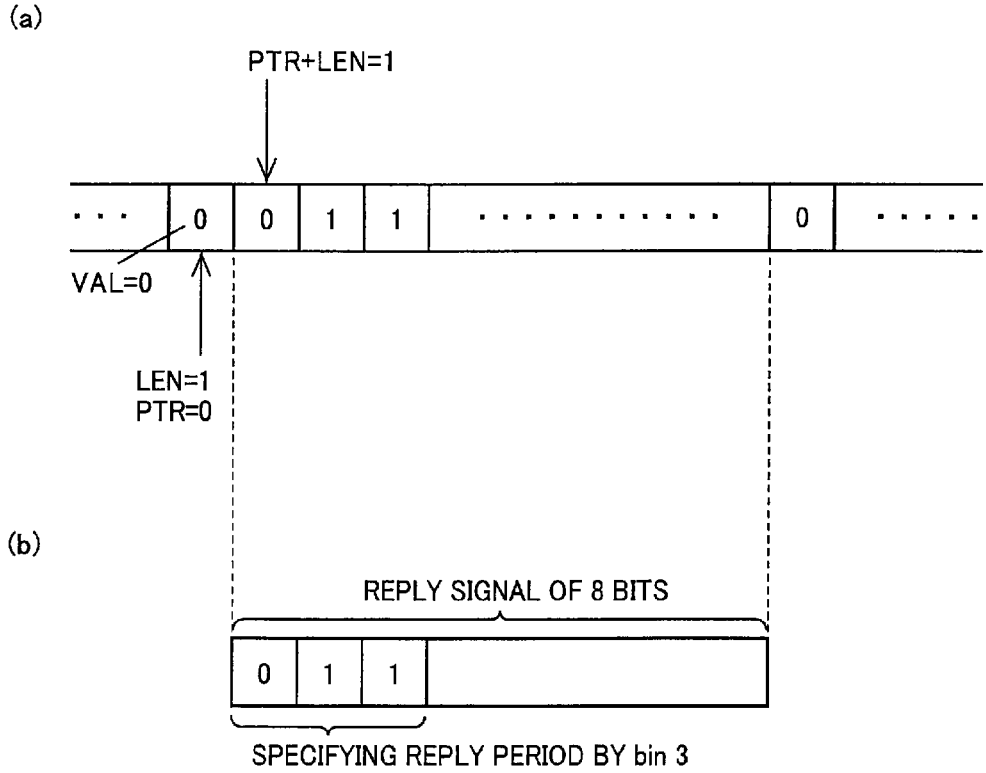
FIG. 23 is a view showing in detail the "SCROLLED ID Reply" of FIG. 17.

The above-described "PING" command of FIG. 15 is used to read out information stored in the memory portion 62 of each of the plurality of RFID tags 12, which information corresponds to the "CRC" and "ID", that is, to specify the reading start position. As shown in FIG. 22, the "PING" command includes the start address pointer "PTR", the data length "LEN", and the value "VAL. Where the number of data sets stored in the memory portion 62, which number is represented by the data length "LEN" as counted from the address represented by the pointer "PTR", is equal to a value represented by the value "VAL", as indicated in FIG. 23, the reply signal consists of 8-bit data sets following the address (PTR+LEN+1). If the number of the data sets stored in the memory portion 62 as represented by the data length "LEN" as counted from the address represented by the pointer "PTR" is not equal to the value represented by the value "VAL", the reply signal is not generated.

Figure 24:
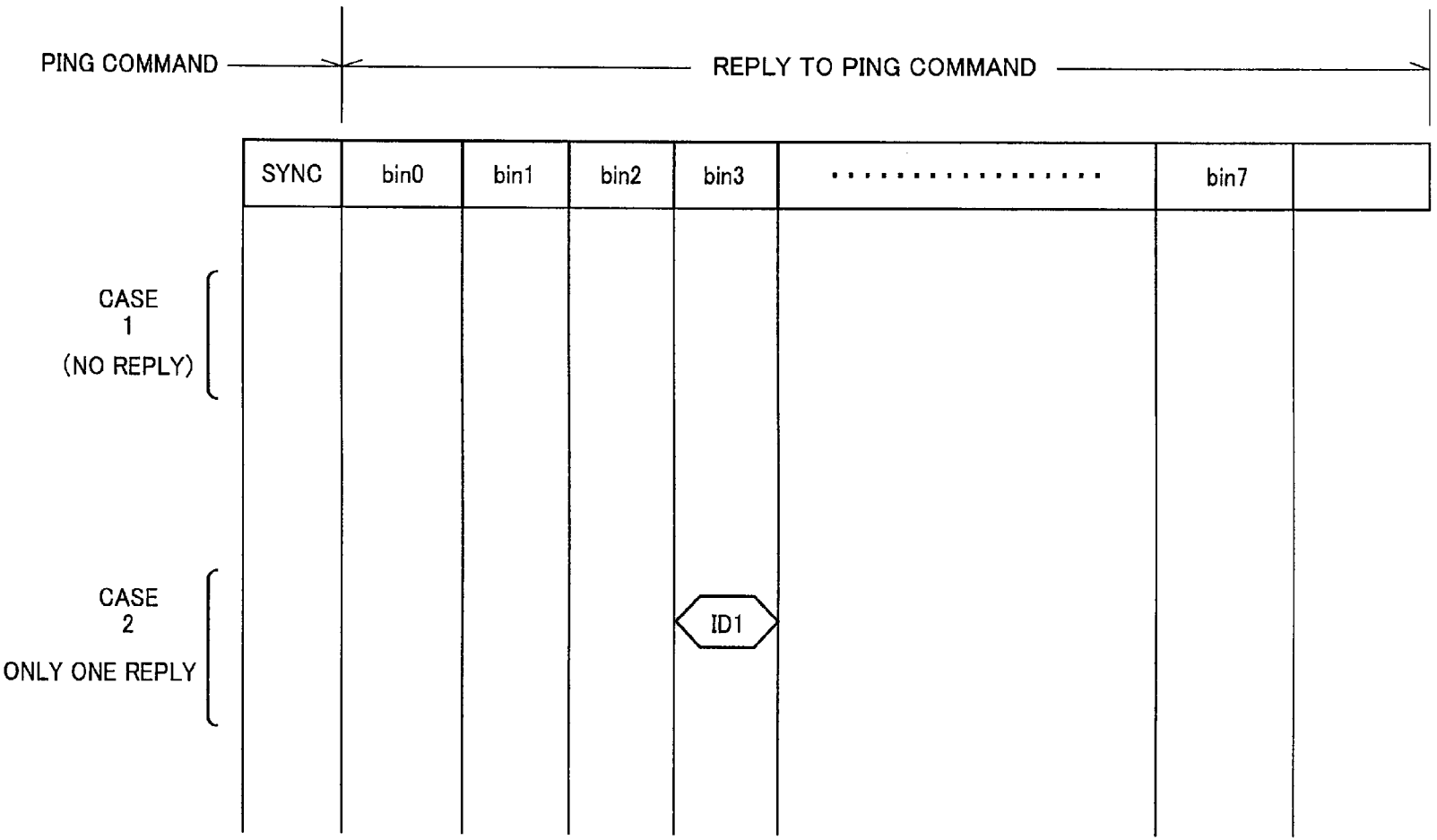
FIG. 24 is a view indicating an example of a reply from a radio-frequency identification tag, which possibly takes place when the radio-frequency identification tag communication device of FIG. 2 operates to identify the radio-frequency identification tags located within an area of possible radio communication.

The timing at which the RFID tag 12 replies to the "PING" command is determined by upper three bits of the reply signal. That is, the reply signal is transmitted during one of periods "bin0" through "bin7" separated from each other by "BIN" pulses transmitted from the radio-frequency identification tag communication device 14, following the "PING" command. Where the "PIN" command includes "PTR=0", "LEN=1" and "VAL=0", for example, the RFID tag 12 wherein the first bit stored in the memory portion 62 is equal to "0" represented by the value "VAL" extracts a signal as shown in FIG. 23, and incorporates this signal into the reply signal. Where the upper three bits of the reply signal are "0", "1" and "1", the reply signal is transmitted in response to the "PING" command, during a reply period "bin3" as indicated in FIG. 24.

Figure 25:
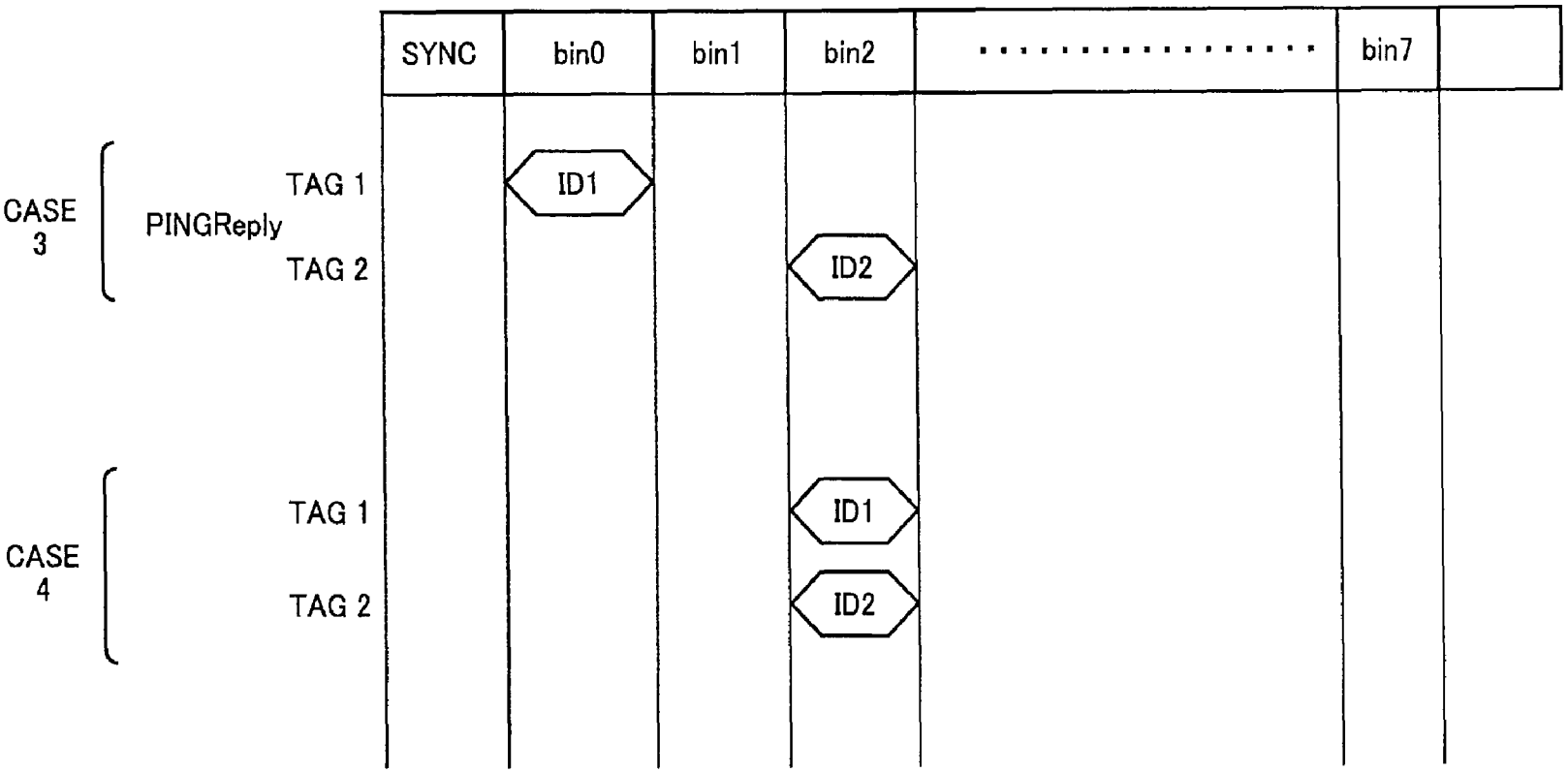
FIG. 25 is a view indicating another example of a reply from a radio-frequency identification tag, which possibly takes place when the radio-frequency identification tag communication device of FIG. 2 operates to identify the RFID tags located within the area of possible radio communication.

The reply to the "PING" command differs depending upon the number of the tags, as described below. That is, where any RFID tag 12 is present within the communication area of the radio-frequency identification tag communication device 14, no reply is transmitted, as in CASE 1 of FIG. 24. Where one RFID tag 12 is present within the communication area, the reply signal indicating "ID1" is transmitted during the period "bin3", for example, as in CASE 2 of FIG. 24. Where two RFID tags 12 are present within the communication area, the reply signal indicating "ID1" is transmitted during a period "bin0", for example, while the reply signal indicating "ID2" is transmitted during a period "bin2", for example, as in CASE 3 of FIG. 25. Where two RFID 12 are present within the communication area, the reply signal indicating "ID1" and the reply signal indicating "ID2" are transmitted during the period "bin2", for example, as in CASE 4 of FIG. 25, if the value of the upper three bits of ID1 and that of the upper three bits of ID2 are equal to each other. The number of the RFID tags 12 within the communication area and the ID of each of the RFID tags 12 can be obtained by repetition of the "PING" command after changing "PTR", "LEN" and "VAL". By using the obtained ID, the information writing on the desired RFID tag 12 can be effected.

The antenna 52 constructed according to the present embodiment of the invention includes the driven meander line portion 72 which has the feed sections ES connected to the IC circuit portion 54 and which is a line conductor formed in a meandering pattern, and the parasitic meander line portion 74 which does not have a feed section connected to the IC circuit portion 54 and which is a line conductor formed in a meandering pattern, and positioned relative to and extending along the driven meander line portion 72, so as to influence the input impedance of the driven meander line portion 72. Accordingly, the input impedance of the driven meander line portion 72 can be made close to the input impedance of the IC circuit portion 54, by suitably positioning the driven and parasitic meander line portions 72, 74. Accordingly, the RFID tag 12 provided with the antenna 52 can be small-sized, with a minimum matching loss of the input impedance of the driven meander line portion 72 with that of the IC circuit portion 54, and with minimum deterioration of the communication characteristics of the antenna 52 such as the communication sensitivity and maximum communication distance. In addition, the provision of the extensions 72*e*, 74*e* at the respective opposite ends of the driven and parasitic meander line portions 72, 74 (at the respective opposite ends of the antenna 52) makes it possible to increase the total lengths of the meander line portions 72, 74 while ensuring a comparatively high electric current density without having to increase the overall size of the antenna 52, thereby permitting a comparatively low resonant frequency of the antenna That is, the present embodiment provides the small-sized antenna 52 which has a good impedance match with the IC circuit portion 54 and which maintains the desired communication characteristics.

The present embodiment is further configured such that each of the extensions 72*e*, 74*e* of the driven and parasitic meander line portions 72, 74 is formed at a longitudinal end part of the corresponding meander line portion 72, 74 in which a density of an electric current is higher than at the other longitudinal end part, during information transmission and reception through the antenna 52. Accordingly, the length of each of the driven and parasitic meander line portions 72, 74 in which the electric current density is sufficiently high can be increased, making it possible to lower the resonant frequency of the antenna 52.

The present embodiment is further configured such that the extensions 72*e*, 74*e* of the driven and parasitic meander line portions 72, 74 have the same length, so that the resonant frequency of the antenna 52 can be lowered.

The present embodiment is further configured such that each of the driven and parasitic meandering portions includes the plurality of transverse conductive sections 76, 80 and the plurality of longitudinal conductive sections 78, 82, 84, which are alternately arranged in the longitudinal direction of the antenna 52, and are alternately connected to each other so as to form the meandering pattern, such that the distance in the longitudinal direction between the adjacent transverse conductive sections 76 of the driven meander line portion 72 and the distance between the adjacent transverse conductive sections 80 of the parasitic meander line portion 74, in longitudinal parts of the meander line portions 72, 74 corresponding to the extensions 72*e*, 74*e*, are smaller than those in the other longitudinal parts of the meandering portions 72, 74. Accordingly, the required longitudinal dimension of the antenna 52 can be minimized.

The present embodiment is further arranged such that the parasitic meander line portion 74 includes a plurality of pairs adjacent transverse conductive sections 80 which do not include the extension 74*e* and each of which is interposed between a corresponding one of a plurality of pairs of adjacent transverse conductive sections 76 of the driven meander line portion 72 each of which does not include the extension 72*e*. In this arrangement wherein the adjacent transverse conductive sections 80 not including the extension 74*e* are interposed between the corresponding adjacent transverse sections 76, the RFID tag 12 provided with the antenna 52 can be small-sized while ensuring the desired communication characteristics of the antenna 52 such as the communication sensitivity and maximum communication distance.

The RFID tag 12 provided with the antenna 12 of the present embodiment for radio communication with the radio-frequency identification tag communication device 14 includes the IC circuit portion 54 having the memory portion 62 for storing the predetermined information. Accordingly, the input impedance of the driven meander line portion 72 can be made close to the input impedance of the IC circuit portion 54, by suitably positioning the driven and parasitic meander line portions 72, 74. Accordingly, the RFID tag 12 provided with the antenna 52 can be small-sized, with a minimum matching loss of the input impedance of the driven meander line portion 72 with that of the IC circuit portion 54, and with minimum deterioration of the communication characteristics of the antenna 52 such as the communication sensitivity and maximum communication distance. In addition, the provision of the extensions 72*e*, 74*e* at the respective opposite ends of the driven and parasitic meander line portions 72, 74 (at the respective opposite ends of the antenna 52) makes it possible to increase the total lengths of the meander line portions 72, 74 while ensuring a comparatively high electric current density without having to increase the overall size of the antenna 52, thereby permitting a comparatively low resonant frequency of the antenna. That is, the present embodiment provides the small-sized RFID tag 12 which has a good impedance match with the IC circuit portion 54 and which maintains the desired communication characteristics.

The other preferred embodiments of the present invention will be described in detail by reference to FIGS. 26-30. In the following description, the same reference signs as used in the first embodiment will be used to identify the functionally corresponding elements.

Figure 26:
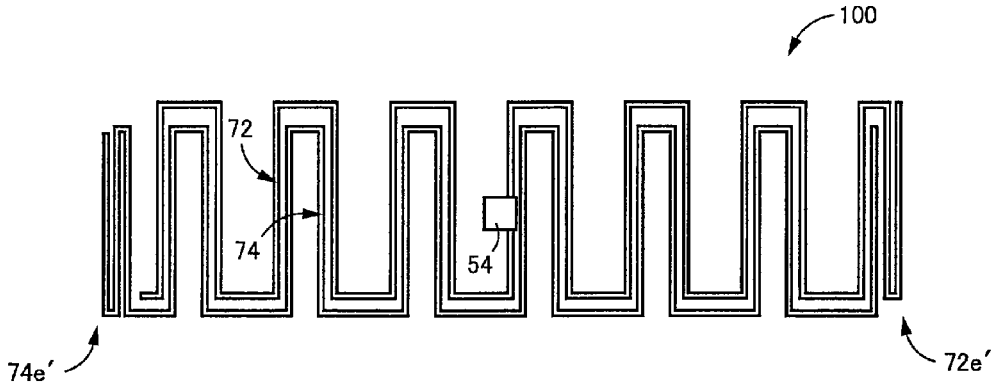
FIG. 26 is a plan view showing an arrangement of an antenna constructed according to another embodiment of this invention.
Figure 27:
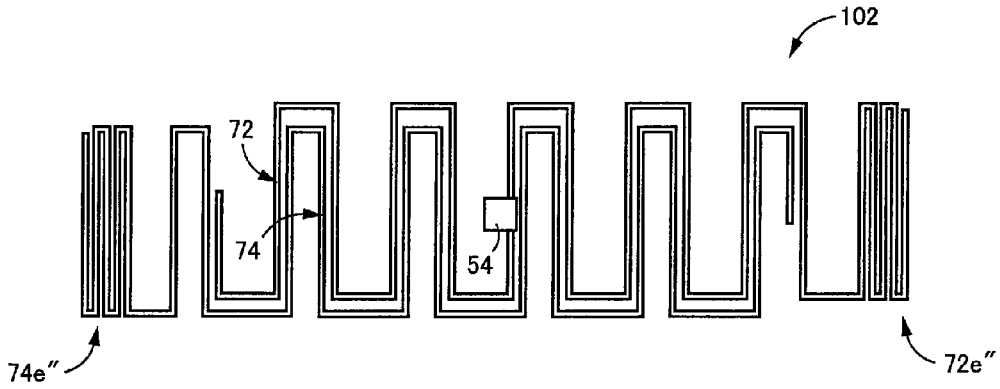
FIG. 27 is a plan view showing an arrangement of an antenna constructed according to a further embodiment of this invention.

Referring to the plan view of FIG. 26, there is illustrated an antenna 100 constructed according to a second embodiment of this invention. In this antenna 100, the driven and parasitic meander line portions 72, 74 have respective extensions 72*e*', 74*e*' the lengths of which are larger than those of the extensions 72*e*, 74*e* in the antenna 52. Further, the meander line portions 72, 74 in the antenna 100 have respective cutout parts having the same length as the extensions 72*e*', 74*e*', which cutout parts are provided the longitudinal ends opposite to the longitudinal ends at which the extensions 72*e*', 74*e*' are formed. FIG. 27 illustrates an antenna 102 according to a third embodiment of the invention that has extensions 72*e*", 74*e*" the lengths of which are larger than those of the extensions 72*e*', 74*e*' of the antenna 100 of FIG. 26. Thus, the lengths of the extensions formed at the opposite longitudinal ends of the driven and parasitic meander line portions 72, 74 are suitably determined depending upon the longitudinal dimension of the antenna and the frequency used for communication with the radio-frequency identification tag communication device 14.

Figure 28:
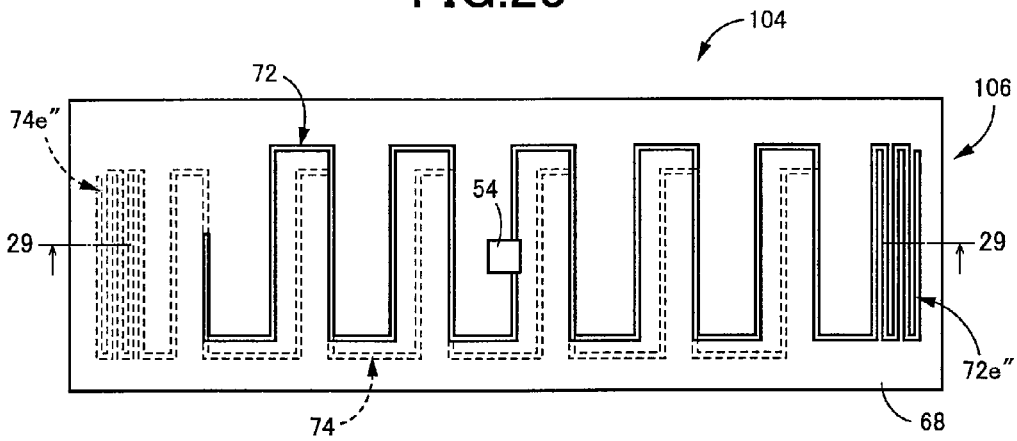
FIG. 28 is a view showing an arrangement of a radio-frequency identification tag constructed according to a further embodiment of this invention.
Figure 29:
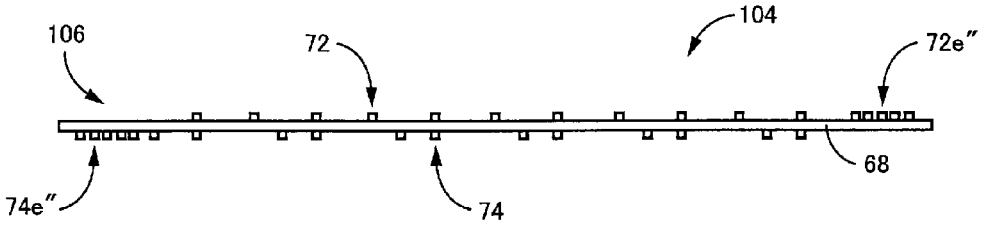
FIG. 29 is a cross sectional view taken along line 29-29 of FIG. 28.

Referring next to the plan view of FIG. 28 and the cross sectional view of FIG. 29 taken along line 29-29 of FIG. 28, there is illustrated a radio-frequency identification tag 104 constructed according to a fourth embodiment of this invention. As shown in these figures, the radio-frequency tag identification 104 includes an antenna 106 wherein the driven and parasitic meander line portions 72, 74 have the respective extensions 72*e*", 74*e*" shown in FIG. 27, which are formed on the respective opposite surfaces of a film member of an electrically insulating material in the form of the substrate 68. The parasitic meander line portion 74 is positioned on the back surface of the substrate 68, relative to the driven meander line portion 72 formed on the front surface of the substrate 68, so as to influence of the input impedance of the driven meander line portion 72.

Figure 30:
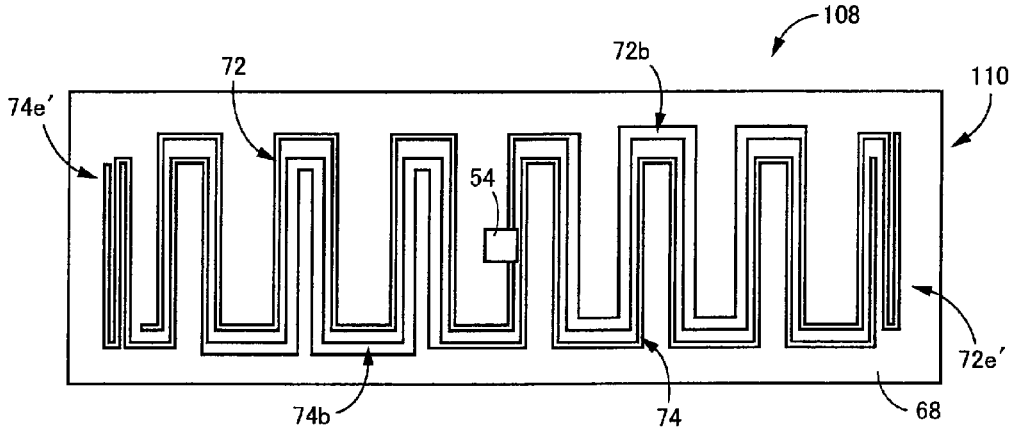
FIG. 30 is a plan view showing an arrangement of a radio-frequency identification tag constructed according to a still further embodiment of the invention.

In the plan view of FIG. 30, there is illustrated a radio-frequency identification tag 108 constructed according to a fifth embodiment of the invention. As shown in FIG. 30, the radio-frequency identification tag 108 includes an antenna 110 wherein the driven and parasitic meander line portions 72, 74 having the respective extensions 72*e*', 74*e*' shown in FIG. 26 include respective large-width parts 72*b*, 74*b* in respective longitudinal parts of the meander line portions 72, 74 in which the electric current density is higher than in the other longitudinal parts during communication through the antenna 110 with the radio-frequency identification tag communication device 14. In the large-width parts 72*b*, 74*b*, the width dimensions of the longitudinal and transverse conductive sections of the meander line portions 72, 74 are larger than in the other longitudinal parts. The provision of the large-width parts 72*b*, 74*b* of the meander line portions 72, 74 in the above-indicated longitudinal parts permits radio communication at a comparatively low resonant frequency while minimizing a loss in the longitudinal parts of the meander line portions 72, 74 in which the electric current density is comparatively high.

While the preferred embodiments of the present invention have been described in detail by reference to the drawings, for illustrative purpose only, it is to be understood that the present invention may be otherwise embodied.

In the antenna 52, etc. according to the preceding embodiments, the adjacent two transverse conductive sections of the parasitic meander line portion 74 are interposed between the corresponding adjacent two transverse conductive sections of the driven meander line portion 72, while the adjacent two transverse conductive sections of the driven meander line portion 72 are interposed between the corresponding adjacent two transverse conductive sections of the parasitic line portion 74, over the entire length of the antenna 52, etc. However, the mutual interposition of the driven and parasitic meander line portions need not be present over the entire length of the antenna. The mutual interposition in a portion of the length of the antenna permits the parasitic meander line portion to influence the input impedance of the driven meander line portion. Further, the mutual interposition is not essential, provided the parasitic meander line portion is positioned relative to the driven meander line portion, so as to influence the input impedance of the driven meander line portion.

In the antenna 52, etc. according to the preceding embodiments, each of the driven and parasitic meander line portions 72, 74 is a succession of meander unit forms (unit patterns) arranged at a predetermined pitch in the longitudinal direction of the antenna. However, the pattern configuration of the driven and parasitic meander line portions 72, 74 may be modified as desired. For example, an antenna may consist of a driven meander line portion and a parasitic meander line portion each of which is a succession of rectangular unit forms wherein a distance between the adjacent two transverse conductive sections decreases with an increase of a distance of a pair of the adjacent two transverse conductive sections from the IC circuit portion 54 in the longitudinal direction of the antenna 162. Further, an antenna may consist of a driven meander line portion and a parasitic meander line portion each of which is a succession of non-rectangular unit forms wherein the length of each transverse conductive section decreases with an increase of the distance of the transverse conductive section from the IC circuit portion 54 in the longitudinal direction of the antenna. In these modified embodiments, too, the antennas can be small-sized, while having a good impedance match with the IC circuit portion and maintain desired communication characteristics.

The RFID tag 12 described above with respect to the illustrated embodiments of the antenna is a passive type which is not provided with a power supply source but is supplied with an electric energy of the interrogating wave $F_c$ received from the radio-frequency identification tag communication device 14. However, the radio-frequency identification tag provided with the antenna of the present invention may be an active type which is provided with a power supply source.

It is to be understood that various modifications not specifically described may be made to the eighth aspect of the invention, without departing from the spirit of the invention.

What is claimed is:

1. An antenna connected to a circuit portion and configured to effect transmission and reception of information by radio communication, said antenna comprising:

a driven meander line portion which has a feed section connected to the circuit portion and which is a line conductor formed in a meandering pattern; and a parasitic meander line portion which does not have a feed section connected to the circuit portion and which is a line conductor formed in a meandering pattern, the parasitic meander line portion being positioned relative to the driven meander line portion, so as to influence an input impedance of the driven meander line portion, wherein the driven and parasitic meander line portions have respective extensions of the line conductors formed at respective opposite longitudinal ends of the antenna, and wherein the extension of the driven meander line portion is disposed at a first end of the antenna and extends beyond a first endpoint of the parasitic meander line portion at the first end of the antenna, and the extension of the parasitic meander line portion is disposed at a second end of the antenna and extends beyond a second endpoint of the driven meander line portion at the second end of the antenna.

2. The antenna according to claim 1, wherein each of the extensions of the driven and parasitic meander line portions is formed at a longitudinal end part of the corresponding meander line portion in which a density of an electric current is higher than at the other longitudinal end part, during information transmission and reception through the antenna.

3. The antenna according to claim 1, wherein the extensions of the driven and parasitic meander line portions have a same length.

4. The antenna according to claim 1, wherein each of the driven and parasitic meandering portions includes a plurality of transverse conductive sections and a plurality of longitudinal conductive sections, which are alternately arranged in a longitudinal direction of the antenna, and are alternately connected to each other so as to form the meandering pattern, such that a distance in the longitudinal direction between the adjacent transverse conductive sections of the driven meander line portion and a distance between the adjacent transverse conductive sections of the parasitic meander line portion, in longitudinal parts of the driven and parasitic meander line portions corresponding to the extensions, are smaller than those in the other longitudinal parts of the meandering portions.

5. The antenna according to claim 4, wherein the parasitic meander line portion includes at least one pair of adjacent transverse conductive sections each of which does not include the extension and each of which is interposed between a pair of adjacent transverse conductive sections of the driven meander line portion, which pair corresponds to the above-indicated each pair of adjacent transverse conductive sections of the parasitic meander line portion and does not include the extension.

6. The antenna according to claim 4, wherein the length of the extensions is less than the length of the transverse conductive sections of the driven and parasitic meander line portions.

7. The antenna according to claim 1, wherein the driven and parasitic meander line portions include respective large-width parts in respective longitudinal and transverse parts thereof in which a density of an electric current is higher in the other longitudinal and transverse parts during communication through the antenna, the driven and parasitic meander line portions having a larger width dimension in the large-width parts than in said other longitudinal and transverse parts.

8. A radio-frequency identification tag for radio communication with a radio-frequency identification tag communication device, said radio-frequency identification tag including an antenna according to claim 1, and wherein said circuit portion is an IC circuit portion having a memory portion for storing predetermined information.

9. The radio-frequency identification tag according to claim 8, wherein the driven and parasitic meander line portions of the antenna of the radio-frequency identification tag are formed on opposite surfaces of a film member of an electrically insulating material.

10. The antenna according to claim 1, wherein the lengths of the extensions are within about 5-16% of the total lengths of the driven and parasitic meander line portions, respectively.

* * * * *